US005201962A

United States Patent [19]

Yamashita et al.

[11] Patent Number: 5,201,962

[45] Date of Patent: Apr. 13, 1993

[54] METHOD OF MAKING PERMANENT MAGNET CONTAINING RARE EARTH METAL AND FERROUS COMPONENT

[75] Inventors: Fumitoshi Yamashita, Ikoma; Masami Wada, Hirakata, both of Japan

[73] Assignee: Matsushita Electric Industrial Co., Ltd., Osaka, Japan

[21] Appl. No.: 552,683

[22] Filed: Jul. 11, 1990

[30] Foreign Application Priority Data

Jul. 12, 1989 [JP] Japan ..... 1-181135

[51] Int. Cl.[5] ..... H01F 1/02

[52] U.S. Cl. ..... 148/101; 148/103; 148/104; 419/12; 419/52

[58] Field of Search ..... 148/101, 102, 103, 104; 419/12, 52

[56] References Cited

U.S. PATENT DOCUMENTS

| | | | |
|---|---|---|---|
| 2,355,954 | 8/1944 | Gremer | 419/52 |
| 4,710,239 | 12/1987 | Lee | 148/101 |
| 4,792,367 | 12/1988 | Lee | 148/104 |
| 4,802,931 | 2/1989 | Croat | 148/302 |
| 4,921,551 | 5/1990 | Vernia et al. | 148/101 |
| 5,000,796 | 3/1991 | Chatterjee | 148/101 |

*Primary Examiner*—John P. Sheehan

*Attorney, Agent, or Firm*—Wenderoth, Lind & Ponack

[57] ABSTRACT

A method of manufacturing a permanent magnet which comprises applying one directional pressure and an electric current to an aggregate through a pair of electrodes to cause the aggregate to undergo a plastic deformation thereby to expand an axially projected surface area. The aggregate used is of a type containing alloy flakes interlocked with each other. The alloy flakes are those made of at least one rare earth metal and a ferrous component by the use of a melt quenching process.

7 Claims, 2 Drawing Sheets

METHOD OF MAKING PERMANENT MAGNET CONTAINING RARE EARTH METAL AND FERROUS COMPONENT

BACKGROUND OF THE INVENTION

1. Field of the Invention

The present invention generally relates to a method of manufacturing a permanent magnet from an alloy containing a rare earth metal and a ferrous component. More specifically, the present invention relates to a method of manufacturing a permanent magnet of a type having a high residual flux density and a high thermal stability, wherein flakes of an alloy containing a rare earth metal and a ferrous component, which is obtained by the use of a melt quenching process, is employed as the starting material.

2. Description of the Prior Art

As disclosed in the U.S. Pat. No. 4,802,931, a flaky alloy containing a rare earth metal and a ferrous component, obtained by the use of a melt quenching process, is known to have a relatively high coercive force and is currently attracting attention as a material for a permanent magnet. To produce this flaky alloy, the melt quenching process is carried out at a cooling rate of, for example, $10^4$° C./sec or higher down from a high temperature melt state with a portion thereof frozen in the melt state. This flaky alloy so obtained is an alloy in non-equilibrium having both an amorphous phase and a magnetic phase expressed by $R_2TM_{14}B$ wherein R represents at least one of rare earth metals, and TM represents either Fe or Fe which is partially substituted by Co. If during the manufacture of the flaky alloy a heat treatment is effected at a temperature higher than the crystallization temperature under an inert atmosphere containing, for example, Ar gas according to a particular requirement, the flaky alloy wherein a $R_2TM_{14}B$ phase is randomly aggregated can be obtained. In particular, if the grain size of the $R_2TM_{14}B$ phase is adjusted to 40 to 400 nm, the maximum intrinsic coercive force can be obtained based on the composition of the alloy, readily reaching the level of a practically utilizable permanent magnet. However, the flaky alloy has a thickness generally within the range of 20 to 30 μm and cannot therefore be used directly as a material for the permanent magnet. Accordingly, the alloy flakes are required to be prepared into an aggregate (billet) of any desired shape by the use of any suitable means while the flakes are interlocked with each other (compacted). As a means for interlocking the alloy flakes, use may be made of a suitable synthetic resin or of a hot press or a two-stage hot press.

A resin-bonded magnet of 80% relative density (volume % relative to full density) manufactured by heat-treating the flaky alloy obtained by the use of the melt quenching process, for example, the flaky alloy of $Nd_{13}Fe_{83}B_4$, at a temperature higher than the crystallization temperature and having the grain size of the $Nd_2Fe_{24}B$ phase which is adjusted to a value within the range of 40 to 400 nm, exhibits 6.1 kG in residual flux density, 15 kOe in intrinsic coercive force with its temperature coefficient being −0.42%/° C., and 310° C. in curie point. In this case, the flakes of the alloy are interlocked with each other by the use of a synthetic resin and, therefore, it is not difficult to cause it to have a relative density higher than 80%. Accordingly, the magnetic characteristics of the resin-bonded magnet referred to above can hardly be enhanced.

On the other hand, the hot-pressed magnet of 98 to 99% relative density wherein the flakes of the alloy of $Nd_{13}Fe_{83}B_4$ have been interlocked with each other with no resin binder employed exhibits 7.9 kG in residual flux density, 16 kOe in intrinsic coercive force with its temperature coefficient being −0.47%/°C., and 310° C. in curie point. Therefore, this hot-pressed magnet can have high magnetic characteristics as compared with those of the resin-bonded magnet, if it is rendered to be of a high density. However, of the three factors, including the intrinsic coercive force, the temperature coefficient of the intrinsic coercive force and the curie point, which remarkedly affect the thermal stability represented by non-reversible demagnetization, the temperature coefficient of the intrinsic coercive force is somewhat high and the level of the residual flux density is lower by about 10 to 30% than the residual flux density of 9.0 to 11.3 kG exhibited by an Sm-Co sintered magnet manufactured according to powdery metallurgy.

A two-stage hot-pressed magnet wherein the hot-pressed magnet of 98 to 90% relative density made of the flaky alloy of $Nd_{13}Fe_{83}B_4$ by the use of the melt quenching process is subjected to a die upsetting exhibits 11.8 kG in residual flux density, 13 kOe in intrinsic coercive force with its temperature coefficient being −0.60%/°C., and 310° C. in curie point. This two-stage hot-pressed magnet can have high magnetic characteristics as compared with those of the hot-pressed magnet by the utilization of the upset forging technique and, in particular, the level of the residual flux density thereof exceeds that of the Sm-Co sintered magnet manufactured according to powdery metallurgy. However, of the three factors, including the intrinsic coercive force, the temperature coefficient of the intrinsic coercive force and the curie point, which remarkedly affect the thermal stability of the magnet represented by non-reversible demagnetization, the temperature coefficient of the intrinsic coercive force is somewhat high and the level of the residual flux density is lowered by about 12 to 13% and the temperature coefficient thereof is increased by about 143%. This means that, even though an extremely high residual flux density is secured, the thermal stability of the magnet such as the non-reversible demagnetization is lowered. Accordingly, the application of the two-stage hot-pressed magnet in various motors or actuators which are generally operated, for example, under a high temperature limited in view of the limited temperature at which they are utilized, and therefore, there has been no way other than to use the Sm-Co sintered magnet of a composition containing Sm and Co, which are more expensive than the permanent magnet containing B and Fe as its principle component which is manufactured with resourceful light rare earth metals such as Nd and Pr.

A method of manufacturing the two-stage hot-pressed magnet known in the art comprises a step of filling the flaky alloy, obtained by the use of the melt quenching process and containing a rare earth metal and a ferrous component, in a molding cavity defined in a mold made of, for example, graphite and preheated to about 700° C. in an inert atmosphere containing an Ar gas or in a vacuum atmosphere, and a step of applying one directional pressure when the alloy flakes are heated to a desired temperature by the heat conduction from the mold or by the application of a high frequency heating source. In other words, this method of making the two-stage hot-pressed magnet requires a heating temperature of 600° to 900° C. and a pressure of 1 to 3 ton/cm$^2$. The subsequent hot-pressing is carried out with the use of a mold having a relatively large surface area. In general, this subsequent hot-pressing requires the use of the heating temperature of about 700° C. and the pressure of 0.7 to 1.5 ton/cm$^2$. This method requires a precise control of the heating temperature and the applied pressure in coordination with time. However, since it is heated to a temperature higher than the crystallization temperature of the $R_2TM_{14}B$ phase, the $R_2TM_{14}B$ phase of the alloy flakes containing the rare earth metal and the ferrous component tends to become coarse. Accordingly, the grain size of the flaky alloy has to be reduced as compared with the size represented by the intrinsic coercive force based on the composition of the alloy.

As hereinbefore discussed, the permanent magnet made of the flaky alloy containing the rare earth metal, for example, B, and the ferrous component, for example, Fe with the use of resourceful light rare earth metals such as, for example, Nd and Pr can give a higher residual flux density, depending on a method for the manufacture thereof, than the Sm-Co sintered magnet containing the expensive Sm and Co. However, the permanent magnet made of the flaky alloy referred to above is susceptible to reduction in intrinsic coercive force or increase in temperature coefficient of the intrinsic coercive force and has therefore a problem in that, due to the reduction of the intrinsic coercive force or the increase of the temperature coefficient thereof, the thermal stability represented by the non-reversible demagnetization tends to be adversely affected. Also, the manufacturing method is complicated with a difficulty involved in precise control and machinability and, therefore, the yield tends to be lowered when it is used as material for the practically utilizable permanent magnets.

SUMMARY OF THE INVENTION

The present invention has been developed in view of the foregoing and is intended to provide an improved method of manufacturing a permanent magnet which is accurately controllable and which is simple enough to cause the permanent magnet to have a residual flux density of 9 to 11.3 kG substantially equal to or higher than that of the Sm-Co sintered magnet and also to have an intrinsic coercive force and its temperature coefficient both comparable to those of the hot-pressed magnet.

Another important object of the present invention is to provide an improved method of the type referred to above which is effective to provide the permanent magnet of any desired shape made of a flaky alloy containing a rare earth metal and a ferrous component, which magnet can exhibit a thermally stabilized state and can therefore be operated in a higher temperature range than that in which the conventional magnet is operated.

To this end, the present invention is featured in that an aggregate wherein the alloy flakes made of the rare earth metal and the ferrous component by the use of the melt quenching process are compacted, is subjected to one directional pressure and an electric current through a pair of electrodes to cause the aggregate to undergo a plastic deformation to expand an area perpendicular to the direction of the applied pressure, i.e. perpendicular to the compacting direction.

In the practice of the present invention, the alloy flakes made by the use of the melt quenching process are those of a non-equilibrium alloy expressed by the material composition $R_xTM_{100-x-y}B_y$, wherein R represents one or both of Nd and Pr; TM represents Fe or Fe which is partially substituted by Co; and x and y represent the atom % of R and B, respectively, and have respective relationships of $13 \leqq x \leqq 15$ and $5 \leqq y \leqq 7$, the alloy having both an amorphous phase and a magnetic phase expressed by $R_2TM_{14}B$. The alloy flakes can be obtained by quenching the alloy, containing the rare earth metal and the ferrous component, from a high temperature melt state at a cooling rare of 104° C./sec or higher with a portion thereof frozen in the melt state.

If a single roll method is employed as a melt quenching means, the resultant alloy flakes have a thickness generally within the range of 20 to 30 μm. The alloy flakes at this stage are generally in the form of an irregular ribbon-like shape and, therefore, it is desirable that the alloy flakes be mechanically pulverized to provide an alloy powder which is to be subsequently adjusted to have a grain size within the range of some tens to several hundreds micrometers to facilitate handling thereof.

The alloy flakes containing the rare earth metal and the ferrous component can exhibit a maximum value of the magnetically isotropic intrinsic coercive force due to its alloy composition if they are conditioned to have a structure wherein the $R_2TM_{14}B$ phase of generally 40 to 400 nm is randomly aggregated. The term "conditioning" herein used means heating the alloy flakes at a temperature higher than the crystallization temperature of the $R_2TM_{14}B$ phase under an inert atmosphere containing, for example, an Ar gas, and if this heat-treatment is effected through a warm rolling, it is possible to cause the alloy flakes to have an easily magnetizable axis in a direction perpendicular to a plane of each alloy flake. The grain size of the $R_2TM_{14}B$ phase of those alloy flakes is preferred to be within the range of 40 to 400 nm so that the intrinsic coercive force attains the maximum value due to the alloy composition, or of a value smaller than that range. If this grain size is greater than 400 nm, the $R_2TM_{14}B$ phase tends to become coarse with the level of the intrinsic coercive force being consequently lowered accompanied by an increase of the temperature coefficient thereof, causing the resultant permanent magnet to lose thermal stability. On the other hand, if the grain size is extremely smaller than 40 nm, the $R_2TM_{14}B$ phase of the resultant permanent magnet will still be small enough to hamper the intrinsic coercive force to attain the maximum value due to the alloy composition and, as a result of the lack of the sufficient level of the intrinsic coercive force, the permanent magnet will readily lose thermal stability.

In order to render the value of the intrinsic coercive force to attain a practical level within the range of the $R_2TM_{14}B$ phase in which the intrinsic coercive force exhibits the maximum value, it is preferred that R is selected to be one of light rare earth metals such as, for example, Nd and/or Pr, the amount of which is within the range of 13 to 15 atom %. If the amount of R is smaller than 13 atom %, the level of the intrinsic coercive force tends to be lowered, accompanied by a lowering of the thermal stability of the permanent magnet manufactured according to the present invention. On the other hand, if the amount of R is greater than 15 atom %, the residual flux density exhibited by the permanent magnet manufactured according to the present invention will be lowered. The selection of the amount of B within the range of 5 to 7 atom % is desirable and effective for facilitating the plastic deformation induced by the application of the one directional pressure and the electric current.

It is to be noted that, in order to secure a thermal stability associated with the temperature coefficient of the residual flux density exhibited by the permanent magnet of the present invention, it is important to increase the curie point and, for this purpose, a portion of Fe may be substituted by Co. While the curie point increases at a rate of about 10° C. for one atom % of Co, an excess over 20 atom % is undesirable because the residual flux density tends to be lowered and also because the temperature coefficient tends to be reduced. Also, one or more of the rare earth metals including Y, as well as one or more of Si, Al, Nb, Hf, Mo, Ga, P and C may be included in a quantity not greater than 3 atom % with which no reduction in residual flux density will occur. Accordingly, from the alloy composition of the alloy flakes containing the rare earth metal and the ferrous component and manufactured by the use of the melt quenching process, an R-TM-B or R-TM-B-M system may be employed.

The aggregate (billet) in which the alloy flakes made by the use of the melt quenching process are firmly interlocked with each other (compacted), which can be employed in the practice of the present invention may be either that in which the alloy flakes are directly fixed relative to each other, or that in which the alloy flakes are interlocked with each other by the use of an organic or inorganic binder. However, regardless of the use of the binder, the aggregate employable in the practice of the present invention should be of a type which would not at least buckle the moment the pressure is applied thereto through the electrodes and which has a value of $\rho$/S.C (wherein $\rho$ represents an intrinsic resistance, S represents the specific gravity and C represents the specific heat) lower than the $\rho$/S.C value of the electrode. The aggregate may have its relative density lowered down to 70% in the presence of voids and/or the binder particles and may also be interposed in a plural number between the electrodes.

The application of the one directional pressure and the electric current to the aggregate through the paired electrodes will now be described. The pressure applied to the aggregate prior to the application of the electric current may be of a small magnitude necessary to electrically connect the aggregate with the paired electrodes. Under the applied pressure, a direct current voltage and/or a low frequency voltage ($0<\omega<\omega pi$, wherein $\omega$ represents the frequency and $\omega pi$ represents the number of vibrations of ion plasmas) are applied across the electrodes to cause a discharge. Thereafter, for the purpose of enhancing the plastic deformation, the applied pressure is increased and, in synchronism therewith, a Joule heat necessary to heat the aggregate is applied thereto by the flow of the electric current across the electrodes. The discharge effected at this initial stage is characterized in the maintenance of a plasma resulting from discharge of primary electrons from the negative electrode (cathode). By the effect of ion bombardment from the plasma, gas molecules adhering to a surface of or surfaces defining interstices in the aggregate sandwiched between the electrodes, and an oxide film deposited thereto can be removed, with the consequence that the surface or surfaces of the aggregate are transformed into an active state, allowing the electric current to flow uniformly therethrough and, at the same time, allowing a diffusion of atoms and the plastic deformation to occur easily. It is to be noted that, in order to suppress a surface oxidization which would occur on the aggregate because of the pressure resulting from the discharged plasma and the increase in temperature of the alloy flakes, it is desirable that the aggregate is placed under a substantial vacuum atmosphere of $10^{-1}$ Torr or higher.

In synchronism with the increase of the pressure applied to the aggregate, the Joule heat is applied by the flow of the electric current through the aggregate as briefly described above. In practice, the increase of the pressure may be followed by the flow of the electric current, and vice versa. By the application of the Joule heat, both the plastic deformation and the bonding of atoms at the interface between each of the neighboring alloy flakes take place. The upper limit to which the pressure is increased should be within the range of 200 to 500 kgf/cm$^2$ per area of the surface projected in the axial direction which will be finally attained as a result of the plastic deformation. If it is smaller than 200 kgf/cm$^2$, the aggregate cannot withstand the distortion resistance.

In order that a permanent magnet of any desired shape can be manufactured according to the present invention with no grinding process employed, use may be made of the pair of the electrodes as a punch in combination with a suitable die or in combination with a core for defining a cavity of any desired shape where the permanent magnet is to be manufactured in the form of a hollow permanent magnet. In particular, where the die and the core are of a floating system, both the side surfaces and end faces of the permanent magnet manufactured according to the present invention can be advantageously shaped to any desired form. Also, if the ratio (S/So) of the area (S) of surface projected in the axial direction of the permanent magnet manufactured according to the present invention relative to the area (So) of surface projected in the axial direction of the aggregate is selected to be within the range of 1.5 to 3.0, the residual flux density of the permanent magnet in the axial direction can be retained at a level substantially equal to that exhibited by the conventional Sm-Co sintered magnet.

BRIEF DESCRIPTION OF THE DRAWINGS

This and other objects and features of the present invention will become clear from the subsequent description taken in conjunction with preferred embodiments thereof with reference to the accompanying drawings, in which:

FIG. 3(*b*) is a graph showing the temperature dependency of a demagnetization curve.

DETAILED DESCRIPTION OF THE INVENTION

Figure 1:
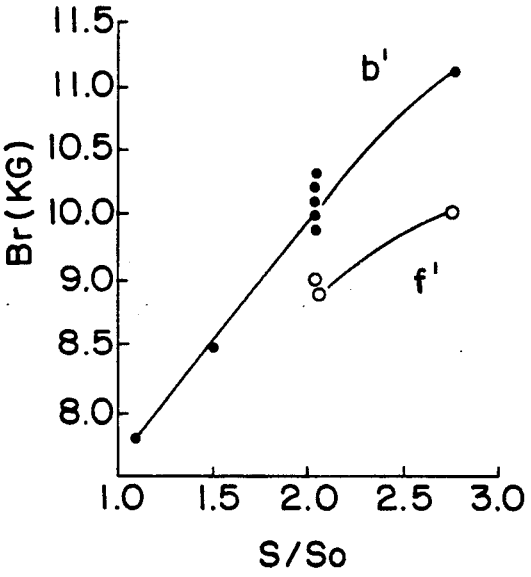
FIG. 1 is a graph showing the relationship between the axially projected surface area of a permanent magnet manufactured according to the present invention relative to that of an aggregate and the residual flux density.

Alloyed matrixes ($Nd_xFe_{100-x-y-z}Co_yB_z$) of respective compositions a, b, c, d, e and f shown in Table 1 were heated by the use of a high frequency heating technique under an Ar gas atmosphere to assume a high temperature melt state, which were subsequently sprayed onto a single roll, made of Cu and driven at a peripheral speed of about 50 m/sec, to provide respective alloy flakes, about 20 μm in thickness, containing a rare earth metal and a ferrous component. The coercive force of the alloy flakes of each composition a to f when magnetized to 50 kOe by the application of a pulse was found to be 3 to 6 kOe.

TABLE 1

| | Matrix Compositions | | | | | |
|---|---|---|---|---|---|---|
| | a | b | c | d | e | f |
| x: | 12.1 | 13.0 | 13.5 | 14.0 | 14.4 | 15.0 |
| y: | 16.2 | 17.8 | 16.0 | 0 | 7.6 | 16.1 |
| z: | 6.3 | 5.8 | 6.0 | 5.5 | 5.0 | 6.0 |

The alloy flakes of each composition a to f were subsequently suitably pulverized to a particle size of 53 to 530 μm and were then heat-treated at 700° C. under an Ar gas atmosphere to provide the heat-treated alloy flakes a', b', c', d', e' and f'. The coercive force of the alloy flakes of each composition a' to f' when magnetized to 50 kOe by the application of a pulse is shown in Table 2 below.

TABLE 2

| | a' | b' | c' | d' | e' | f' |
|---|---|---|---|---|---|---|
| Hcj kOe: | 9.0 | 17.4 | 16.3 | 16.0 | 17.0 | 16.1 |

The alloyed flakes of each composition were filled in respective cylindrical cavities of 7.3 mm, 12 mm, 14 mm, 16 mm and 19 mm in inner diameter each defined by a pair of graphite electrodes and a die, followed by the application of a pressure of 300 kgf/cm$^2$ through the electrodes to allow an electric current to flow directly thereacross for 12 to 20 seconds under a vacuum atmosphere of $10^{-1}$ to $10^{-2}$ Torr. Each of the electrodes used has a $\rho$/S.C at a level of $10^{-3}$ and the current density was 400 to 480 A/cm$^2$ in the axially horizontal area. The alloy flakes in each cavity exhibits an increase in temperature as a result of a Joule heat induced by the application of both the pressure and the electric current. Although at this time a plastic deformation and a direct bonding of the alloy flakes progress, the supply of the electric current is interrupted at a stage when the relative density is still small, allowing them to cool to provide a respective cylindrical aggregate wherein the alloy flakes are interlocked with each other and which exhibits the $\rho$/S.C value at a level within the range of $10^{-4}$ to $10^{-5}$.

Subsequently, each aggregate was placed in a cylindrical cavity of 20 mm in inner diameter comprised of a die of floating system and graphite electrodes of $10^{-3}$ in $\rho$/S.C level, followed by the application of a pressure of 50 kgf/cm$^2$ through the electrodes to cause the respective aggregate to be electrically connected with the electrodes. Then, under a vacuum atmosphere of $10^{-1}$ to $10^{-2}$ Torr, a direct current voltage of 20 volts having a pulse width of 40 msec was applied for 60 seconds to form a discharge plasma within the cavity. Thereafter, the direct supply of an electric current of 1.5 kA was carried out for 40 to 60 seconds and, in unison therewith, the pressure was increased to 942 kgf.

It is to be noted that the pressure of 942 kgf corresponds to 300 kgf/cm$^2$ per axially projected surface area which is finally attained upon the plastic deformation. In this case, each aggregate is a product of both the self-heating due to the Joule heat and a heat current from the electrodes, and the plastic deformation takes place at an average speed of $10^{-4}$ mm/sec. This average speed is very high for the rate of strain. Accordingly, the supply of the electric current for 40 to 60 seconds resulted in the temperature of the die having finally attained 700° to 750° C. By cooling each aggregate subsequently, a respective permanent magnet, about 20 mm in outer diameter, and having a permeance coefficient $Pc \approx 1$, was obtained. Respective kinds a to f and a' to f' of alloy flakes used for the permanent magnets so manufactured, the respective relative densities RD (%) of the aggregates used for the permanent magnets so manufactured, the number n of the aggregates placed in the cavities, the ratio S/So of the axially projected surface areas of the permanent magnets so manufactured relative to those of the respective aggregates, the intrinsic coercive forces Hcj thereof at a room temperature subsequent to the magnetization to 50 kOe by the application of pulses, and the respective residual flux densities Br thereof are tabulated in Table 3.

TABLE 3

| Sample No. | Flake Type | RD (%) | n | S/So | Hcj (kOe) | Br (kG) |
|---|---|---|---|---|---|---|
| 1 | b' | 96 | 1 | 2.04 | 10.5 | 10.1 |
| 2 | b' | 96 | 2 | 2.04 | 10.5 | 10.0 |
| 3 | b' | 92 | 1 | 2.04 | 11.2 | 9.9 |
| 4 | b' | 78 | 1 | 2.04 | 13.4 | 10.3 |
| 5 | b' | 74 | 1 | 2.04 | 13.1 | 10.4 |
| 6 | b' | 72 | 1 | 2.04 | 12.9 | 10.4 |
| 7 | b' | 78 | 1 | 1.10 | 13.0 | 8.3 |
| 8 | b' | 85 | 5 | 1.51 | 13.1 | 9.0 |
| 9 | b' | 85 | 2 | 2.78 | 12.9 | 11.1 |
| 10 | b | 96 | 1 | 2.04 | 14.7 | 10.3 |
| 11 | b | 94 | 1 | 2.04 | 16.1 | 10.5 |
| 12 | a' | 76 | 1 | 2.04 | 5.1 | 10.0 |
| 13 | c' | 78 | 1 | 2.04 | 14.1 | 10.4 |
| 14 | e' | 93 | 1 | 2.04 | 10.4 | 10.4 |
| 15 | e' | 93 | 2 | 2.78 | 10.1 | 11.3 |
| 16 | f' | 94 | 1 | 2.04 | 13.8 | 9.4 |
| 17 | f' | 79 | 1 | 2.04 | 16.3 | 9.5 |
| 18 | f' | 73 | 1 | 2.78 | 15.5 | 10.0 |

(hm 50 kOe, Po ≈ 1)

FIG. 1 illustrates a graph showing the relationship between the ratio S/So and the residual flux density Br obtained by each aggregate shown in Table 3. In the graph of FIG. 1, b' represents the employment of 13 atom % of Nd, f' represents the employment of 15 atom % of Nd, and their original flakes have respective coercive forces of about 16 to 17 kOe. With respect to b' and f', the residual flux density in the axial direction is high as compared with the ratio S/So. In particular, b' has exhibited that, when the ratio S/So is about 1.5, the residual flux density thereof is of a level of 9 kG, but when the ratio S/So is about 3.0, the residual flux density readily exceeds 11 kG. This level of the residual flux density apparently corresponds to 9 kG exhibited by, for example, $SmCo_5$, which is the Sm-Co sintered magnet, and also to 10.5 to 11.3 kG exhibited by Sm(Co, Fe, Cu, Zr). It is to be noted that, when b' and f' are compared with each other for the same ratio S/So, f' wherein Nd is employed in a quantity of 15 atom % exhibits a higher residual flux density than that exhibited by b'.

Figure 2:
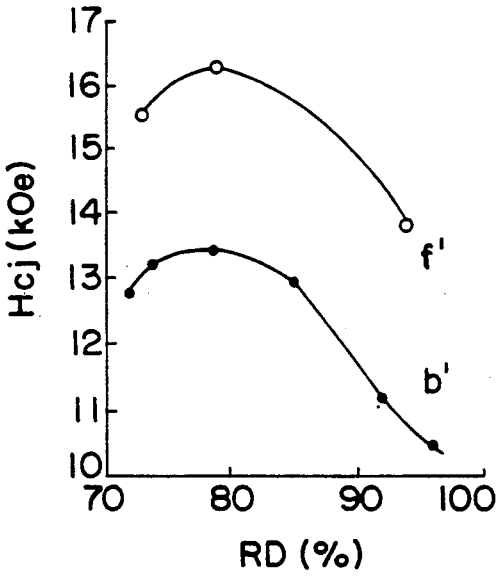
FIG. 2 is a graph showing the relationship between the relative density of the aggregate and the intrinsic coercive force.

FIG. 2 illustrates a graph showing the relationship between the relative density RD and the intrinsic coercive force of the respective aggregate of each of b' and f', which is based on Table 3. Even though the grain size of the $R_2TM_{14}B$ phase has been rendered to attain a level comparable with the maximum value of the intrinsic coercive force based on the alloy composition resulting from the heat-treatment, the use of Nd within the range of 13 to 15 atom % would result in the intrinsic coercive force of 10 kOe or higher regardless of the ratio S/So. However, even if the alloy composition and the grain size of the $R_2TM_{14}B$ phase remain the same, the intrinsic coercive force tends to be affected by the relative density of the aggregate. The relative density of the aggregate is preferred to be within the range of about 70 to 90%.

Figure 3A:
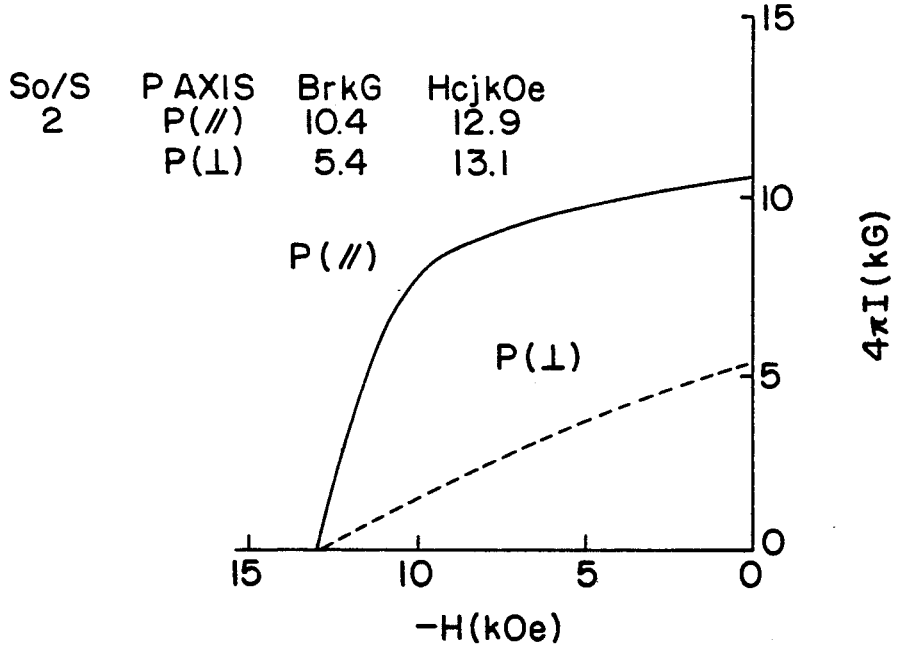
FIG. 3(*a*) is a graph showing respective demagnetization curves in the axial direction and in a direction perpendicular to the axial direction.
Figure 3B:
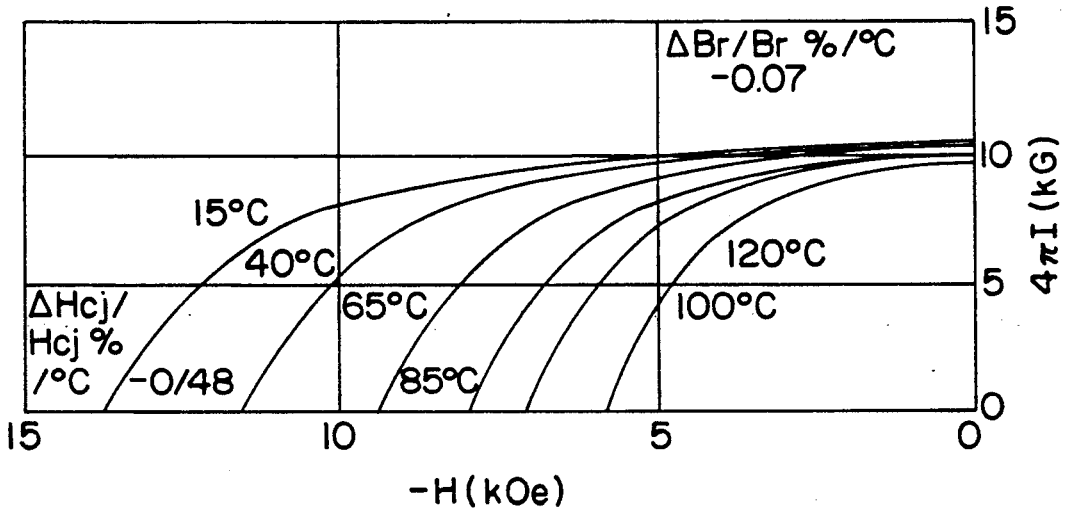

FIGS. 3(*a*) and 3(*b*) illustrate the demagnetizing curves in the axial direction and in a direction perpendicular to the axial direction, and the relationship between the temperature coefficient of the residual flux density and the temperature coefficient of the intrinsic coercive force, both obtained when the sample No. 6 shown in Table 3 has been ground and machined.

It is clear from the graphs that magnetic anisotropy develops in the axial direction in which the pressure has been applied. However, the temperature coefficient of the residual magnetic flux is −0.07% which is very small for the permanent magnet manufactured by the method of the present invention, particularly because of the effect of substitution of Co for a portion of Fe. Also, one thing to note is that the temperature coefficient of the intrinsic coercive force which would bring about a marked influence on the thermal stability represented by the nonreversible demagnetization is −0.48%/°C., which is very small notwithstanding the permanent magnet according to the present invention in which the magnetic anisotropy has developed. This value is at a level comparable with the hot-pressed magnet which is magnetically isotropic and smaller by 20% than that of the two-stage hot-pressed magnet which is magnetically anisotropic.

Figure 4:
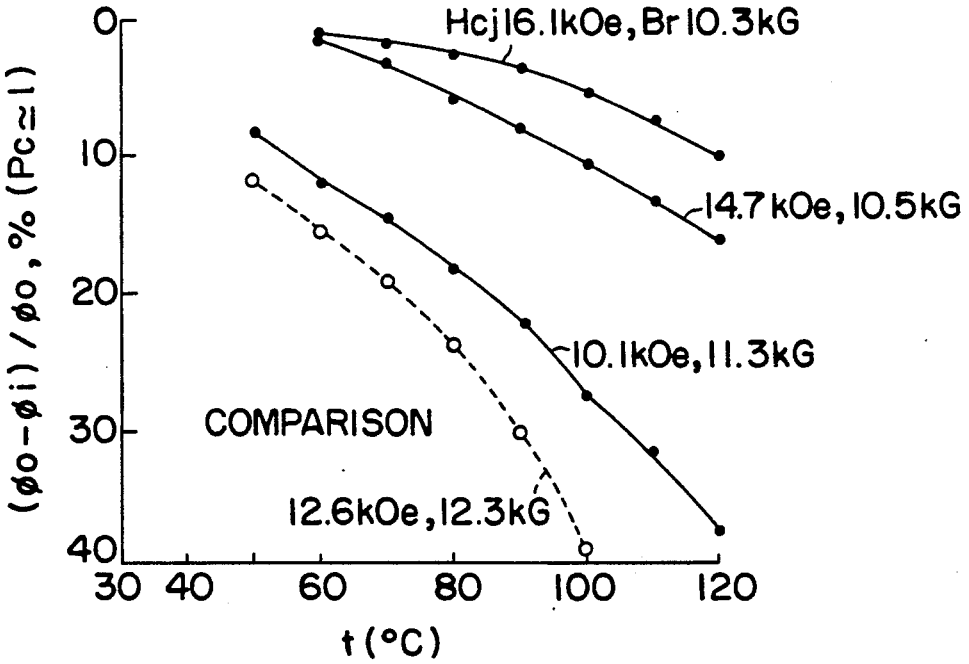
FIG. 4 is a graph showing the temperature dependency of a non-reversible demagnetizing factor.

FIG. 4 illustrates a graph of the comparison between the temperature dependency of each of the samples No. 10, No. 11 and No. 15 shown in Table 3 and having respective levels of intrinsic coercive force shown in Table 3, relative to the non-reversible demagnetizing factor and that of the commercially available Nd-Fe(-Co)-B sintered magnet (referred to as Comparison). It is to be noted that each of the samples is 20 mm in outer diameter and has a permeance coefficient Pc ÷ 1, and the non-reversible demagnetizing factor $(\phi o-\phi i)/\phi o$ for each temperature was calculated by determining the total amount $\phi o$ of magnetic fluxes after it has been magnetized to 50 kOe by the application of a pulse according to a search coil drawing method and then, after it has been heated for one hour to an arbitrarily chosen temperature, determining again the total amount $\phi i$ of the magnetic fluxes at a room temperature. The commercially available Nd-Fe(Co)-B sintered magnet is the one manufactured according to powder metallurgy and having such magnetic characteristics as 12.6 kOe in intrinsic coercive force, −0.60%/° C. in temperature coefficient of the intrinsic coercive force, and 12.3 kG in residual flux density.

As can be understood from FIG. 4, even though the intrinsic coercive force is 10.1 kOe, the permanent magnet manufactured according to the method of the present invention exhibits a non-reversible demagnetizing factor which is lower than that exhibited by the commercially available sintered magnet (Comparison). Compared with the permanent magnet manufactured according to the method of the present invention, the non-reversible magnetizing factor will be considerably lowered when the level of the intrinsic coercive force attains about 15 kOe and, therefore, the permanent magnet manufactured according to the method of the present invention can advantageously be used in a high temperature environment.

Thus, according to the present invention, the permanent magnet can be manufactured with the use of, as the starting material, the alloy flakes containing, in addition to B and/or Fe as its principle component, one or more of the resourceful rare earth metals such as, for example, Nd and Pr, which flakes have been made by the use of the melt quenching process. Important points of the magnet manufacturing method of the present invention lie in the direct temperature increase based on the Joule heat and the discharge at a sec level and the application of the pressure in synchronism therewith. Accordingly, an advantage can be appreciated in that an accurate control is possible and a quick processing is also possible. This is very important in suppressing the lowering of the intrinsic coercive force, and the corresponding increase in temperature coefficient thereof, which would otherwise result from the $R_2TM_{14}B$ phase of the inventive permanent magnet becoming coarse. Also, not only can a residual flux density substantially equal to the level of 9 to 11 kG exhibited by the Sm-Co sintered magnet based on powdery metallurgy be accomplished, but also the thermal stability represented by the non-reversible demagnetization will be high.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A method of manufacturing a permanent magnet, which comprises providing at least one billet having a relative density within the range of 70 to 90% and containing compacted alloy flakes, said alloy flakes being made of at least one rare earth metal and a ferrous component and being obtained by a melt quenching process; and applying one directional pressure and an electric current to said billet through a pair of electrodes to cause said billet to undergo a plastic deformation, wherein the application of the pressure is carried out at least at a stage of application of a Joule heat at a pressure of 200 to 500 kgf/cm$^2$ with a final axial sectional surface area taken as a reference, thereby to expand an area of said billet perpendicular to the direction of the applied pressure.

2. The method as claimed in claim 1, wherein said alloy flakes are flakes of a non-equilibrium alloy expressed by the material composition , $RxTM_{100-x-y}By$, wherein R represents one or both of Nd and Pr; TM represents Fe or Fe which is partially substituted by Co; and x and y represent the atom % of R and B, respectively, and have respective relationships of $13 \leqq x \leqq 15$ and $5 \leqq y \leqq 7$, said alloy having both an amorphous phase and a magnetic phase expressed by $R_2TM_{14}B$.

3. The method as claimed in claim 1, wherein the value of $\rho$/S.C (wherein $\rho$, S and C represent the intrinsic resistance, the specific gravity and the specific heat, respectively) of said electrodes is greater than that of the billet.

4. The method as claimed in claim 1, wherein the application of the pressure and the electric current is carried out under an atmosphere of $10^{-1}$ Torr or lower.

5. The method as claimed in claim 1, wherein the application of the electric current is carried out in two stages including a discharge and an application of a Joule heat.

6. The method as claimed in claim 1, wherein the ratio (S/So) of a projected sectional surface area (S) of the permanent magnet relative to a projected sectional surface area (So) of the billet is within the range of 1.5 to 3.0.

7. The method as claimed in claim 1, wherein the pressure and current are applied to a stack of a plurality of said billets.

* * * * *